US009003686B2

(12) United States Patent
Brown

(10) Patent No.: US 9,003,686 B2
(45) Date of Patent: Apr. 14, 2015

(54) HAND GUARD MOUNTING MECHANISM

(71) Applicant: Adcor Industries, Inc., Baltimore, MD (US)

(72) Inventor: Michael J. Brown, Baltimore, MD (US)

(73) Assignee: Adcor Industries, Inc., Baltimore, MD (US)

( * ) Notice: Subject to any disclaimer, the term of this patent is extended or adjusted under 35 U.S.C. 154(b) by 31 days.

(21) Appl. No.: 13/766,571

(22) Filed: Feb. 13, 2013

(65) Prior Publication Data

US 2014/0223794 A1 Aug. 14, 2014

Related U.S. Application Data

(60) Provisional application No. 61/597,980, filed on Feb. 13, 2012.

(51) Int. Cl.
*F41A 21/00* (2006.01)
*F41C 23/16* (2006.01)

(52) U.S. Cl.
CPC ..... *F41C 23/16* (2013.01)

(58) Field of Classification Search
CPC ..... F41C 23/16; F41A 11/02
USPC ..... 42/75.01–75.04
See application file for complete search history.

(56) References Cited

U.S. PATENT DOCUMENTS

| | | | |
|---|---|---|---|
| 1,379,989 | A | 5/1921 | Johnson |
| 1,402,459 | A | 1/1922 | Swebilius |
| 1,846,993 | A | 2/1932 | Destree |
| 1,878,038 | A | 9/1932 | Von Frommer |
| 2,341,767 | A | 2/1944 | Gans |

(Continued)

OTHER PUBLICATIONS

Article entitled "The USA's M4 Carbine Controversy" dated Feb. 2, 2009; www.defenseindustrydaily.com/the-usas-m4-carbone-controversy-03289/.

(Continued)

*Primary Examiner* — Samir Abdosh
(74) *Attorney, Agent, or Firm* — Howard & Howard Attorneys PLLC

(57) ABSTRACT

A firearm comprising a receiver including a threaded end with the receiver extending along an axis and a hand guard having an exterior surface and defining a hand guard bore along the axis with the exterior surface terminating at a mating surface disposed about the threaded end. The firearm additionally includes a barrel disposed within the hand guard bore and abutting the threaded end and a nut abutting the barrel and engaging the threaded end of the receiver to secure the barrel to the receiver. The firearm further including a securing device with the exterior surface of the hand guard defining an engagement area providing access into the hand guard bore and the securing device interfacing with the engagement area and extending into the hand guard bore to abut the nut and securely mount the mating surface of the hand guard to the receiver.

20 Claims, 7 Drawing Sheets

(56) References Cited

U.S. PATENT DOCUMENTS

| | | | | |
|---|---|---|---|---|
| 2,462,119 | A | 2/1949 | Moore | |
| 2,685,754 | A | 8/1954 | Crittendon et al. | |
| 2,752,826 | A | 7/1956 | Simpson | |
| 2,775,116 | A | 12/1956 | Janson | |
| 2,780,145 | A | 2/1957 | Saive | |
| 2,783,685 | A | 3/1957 | Green | |
| 2,882,635 | A | 4/1959 | Hill | |
| 2,951,424 | A | 9/1960 | Stoner | |
| 3,075,314 | A | 1/1963 | Bakker | |
| 3,090,150 | A | 5/1963 | Stoner | |
| 3,176,424 | A | 4/1965 | Hoge | |
| 3,198,076 | A | 8/1965 | Stoner | |
| 3,236,155 | A | 2/1966 | Sturtevant | |
| 3,255,667 | A | 6/1966 | Walther | |
| 3,300,889 | A | 1/1967 | Baker | |
| 3,368,298 | A | 2/1968 | Browning | |
| 3,397,473 | A | 8/1968 | Browning | |
| 3,405,470 | A | 10/1968 | Wesemann | |
| 3,592,101 | A | 7/1971 | Vartaninan et al. | |
| 3,618,457 | A | 11/1971 | Miller | |
| 3,619,926 | A | 11/1971 | Alday | |
| 3,675,534 | A | 7/1972 | Beretta | |
| 3,686,998 | A | 8/1972 | Seifried | |
| 3,742,636 | A | 7/1973 | Dealy et al. | |
| 3,771,415 | A | 11/1973 | Into et al. | |
| 3,774,498 | A | 11/1973 | Moller et al. | |
| 3,776,095 | A | 12/1973 | Atchisson | |
| 3,938,271 | A | 2/1976 | Hyytinen | |
| 3,938,422 | A | 2/1976 | Tellie | |
| 3,960,053 | A | 6/1976 | Conley | |
| 3,969,980 | A | 7/1976 | Brandstatter et al. | |
| 3,999,461 | A | 12/1976 | Johnson et al. | |
| 4,020,741 | A | 5/1977 | Junker | |
| 4,044,487 | A | 8/1977 | Hutton et al. | |
| 4,088,057 | A | 5/1978 | Nasypany | |
| 4,125,054 | A | 11/1978 | Jennie | |
| 4,244,273 | A | 1/1981 | Langendorfer, Jr. et al. | |
| 4,246,830 | A | 1/1981 | Krieger | |
| 4,358,986 | A | 11/1982 | Giorgio | |
| 4,389,920 | A | 6/1983 | Dufour, Sr. | |
| 4,398,448 | A | 8/1983 | LaFever | |
| 4,505,182 | A | 3/1985 | Sullivan | |
| 4,536,982 | A | 8/1985 | Bredbury et al. | |
| 4,553,469 | A | 11/1985 | Atchisson | |
| 4,654,993 | A | 4/1987 | Atchisson | |
| 4,663,875 | A | 5/1987 | Tatro | |
| 4,689,911 | A | 9/1987 | White | |
| 4,693,170 | A | 9/1987 | Atchisson | |
| 4,703,826 | A | 11/1987 | Byron | |
| 4,756,228 | A | 7/1988 | Rath | |
| 4,765,224 | A | 8/1988 | Morris | |
| 4,766,800 | A | 8/1988 | Miller et al. | |
| 4,867,039 | A | 9/1989 | Dobbins | |
| 4,893,547 | A | 1/1990 | Atchisson | |
| 4,972,617 | A | 11/1990 | Major | |
| 5,198,600 | A | 3/1993 | E'Nama | |
| 5,343,650 | A | 9/1994 | Swan | |
| 5,351,598 | A | 10/1994 | Schuetz | |
| 5,540,008 | A | 7/1996 | Kirnstatter | |
| 5,590,484 | A | 1/1997 | Mooney et al. | |
| 5,821,445 | A | 10/1998 | Guhring | |
| 5,824,923 | A | 10/1998 | Kondoh et al. | |
| 5,824,943 | A | 10/1998 | Guhring et al. | |
| 5,826,363 | A | 10/1998 | Olson | |
| 5,827,992 | A | 10/1998 | Harris et al. | |
| 5,918,401 | A | 7/1999 | Rowlands | |
| 5,945,626 | A | 8/1999 | Robbins | |
| 6,019,024 | A | 2/2000 | Robinson et al. | |
| 6,134,823 | A | 10/2000 | Griffin | |
| 6,311,603 | B1 | 11/2001 | Dunlap | |
| 6,418,655 | B1 | 7/2002 | Kay | |
| 6,453,594 | B1 | 9/2002 | Griffin | |
| 6,481,145 | B2 | 11/2002 | Weichert et al. | |
| 6,499,246 | B1 | 12/2002 | Zedrosser | |
| 6,564,491 | B2 | 5/2003 | Murello | |
| 6,609,321 | B2 | 8/2003 | Faifer | |
| 6,619,592 | B2 | 9/2003 | Vignaroli et al. | |
| 6,625,916 | B1 | 9/2003 | Dionne | |
| 6,634,274 | B1 | 10/2003 | Herring | |
| 6,671,990 | B1 | 1/2004 | Booth | |
| 6,694,660 | B1 * | 2/2004 | Davies | 42/75.01 |
| 6,722,255 | B2 | 4/2004 | Herring | |
| 6,732,466 | B2 | 5/2004 | Bentley | |
| 6,779,288 | B1 | 8/2004 | Kim | |
| 6,782,791 | B2 | 8/2004 | Moore | |
| 6,829,858 | B2 | 12/2004 | Gablowski | |
| 6,848,351 | B1 | 2/2005 | Davies | |
| 7,000,345 | B1 | 2/2006 | Kay | |
| 7,131,228 | B2 | 11/2006 | Hochstrate et al. | |
| RE39,465 | E | 1/2007 | Swan | |
| 7,231,861 | B1 | 6/2007 | Gauny et al. | |
| RE40,216 | E | 4/2008 | Swan | |
| 7,418,898 | B1 | 9/2008 | Desomma | |
| 7,448,307 | B1 | 11/2008 | Dafinov | |
| 7,461,581 | B2 | 12/2008 | Leitner-Wise | |
| 7,469,624 | B1 | 12/2008 | Adams | |
| 7,478,495 | B1 | 1/2009 | Alzamora et al. | |
| 7,640,689 | B2 | 1/2010 | Fluhr | |
| 7,770,317 | B1 * | 8/2010 | Tankersley | 42/71.01 |
| 7,793,452 | B1 * | 9/2010 | Samson et al. | 42/72 |
| 7,832,326 | B1 | 11/2010 | Barrett | |
| 7,905,041 | B1 | 3/2011 | Davies | |
| 7,937,870 | B2 | 5/2011 | Brown | |
| 7,938,055 | B2 | 5/2011 | Hochstrate et al. | |
| 7,941,959 | B1 * | 5/2011 | Swan | 42/85 |
| 8,046,949 | B1 | 11/2011 | Daniel | |
| 8,141,285 | B2 * | 3/2012 | Brown | 42/71.01 |
| 8,276,304 | B2 * | 10/2012 | Samson et al. | 42/75.02 |
| 8,336,243 | B2 | 12/2012 | Langevin et al. | |
| 8,347,540 | B2 * | 1/2013 | Sirois | 42/75.01 |
| 8,607,490 | B1 * | 12/2013 | Zinsner | 42/71.01 |
| 8,640,372 | B2 * | 2/2014 | Hochstrate et al. | 42/75.01 |
| 2003/0074822 | A1 | 4/2003 | Faifer | |
| 2003/0230022 | A1 | 12/2003 | Battaglia | |
| 2005/0115134 | A1 | 6/2005 | Bond et al. | |
| 2005/0115398 | A1 | 6/2005 | Olson | |
| 2005/0262752 | A1 | 12/2005 | Robinson et al. | |
| 2006/0065112 | A1 | 3/2006 | Kuczynko et al. | |
| 2006/0156606 | A1 | 7/2006 | Robinson et al. | |
| 2006/0236582 | A1 | 10/2006 | Lewis et al. | |
| 2006/0254112 | A1 | 11/2006 | Snoderly | |
| 2006/0260169 | A1 * | 11/2006 | Samson et al. | 42/72 |
| 2007/0033851 | A1 | 2/2007 | Hochstrate et al. | |
| 2007/0199435 | A1 | 8/2007 | Hochstrate et al. | |
| 2007/0261285 | A1 * | 11/2007 | Troy | 42/75.03 |
| 2008/0110074 | A1 | 5/2008 | Bucholtz et al. | |
| 2008/0301994 | A1 * | 12/2008 | Langevin et al. | 42/71.01 |
| 2009/0000173 | A1 | 1/2009 | Robinson et al. | |
| 2009/0007477 | A1 | 1/2009 | Robinson et al. | |
| 2009/0031605 | A1 | 2/2009 | Robinson | |
| 2009/0031606 | A1 | 2/2009 | Robinson et al. | |
| 2009/0031607 | A1 | 2/2009 | Robinson et al. | |
| 2009/0056191 | A1 | 3/2009 | Battaglia | |
| 2009/0178325 | A1 | 7/2009 | Veilleux | |
| 2010/0300277 | A1 | 12/2010 | Hochstrate et al. | |
| 2010/0319231 | A1 | 12/2010 | Stone et al. | |
| 2011/0061281 | A1 * | 3/2011 | Kapusta et al. | 42/71.01 |
| 2013/0205637 | A1 * | 8/2013 | Patel | 42/75.02 |
| 2013/0276341 | A1 * | 10/2013 | Wells et al. | 42/71.01 |
| 2014/0026459 | A1 * | 1/2014 | Yan et al. | 42/71.01 |
| 2014/0144059 | A1 * | 5/2014 | Geissele | 42/71.01 |

OTHER PUBLICATIONS

Article entitled "M4 Carbine Review"dated May 4, 2007; http//home.comcast.net/shooter2_indy/m4.html.

Article entitled "Critics Turn Crosshairs on Military's Main Rifle" dated Apr. 20, 2008 from the website "USA TODAY"; www.usatoday.com/news/military/2008-04-20-gunwars_N.htm.

Parts Schematic entitled "Schematic For Bushmaster M4A3 Carbine" from the website "Bushmaster" dated Jun. 2008; www.bushmaster.com/electronic-documents/operation-manual/opmanual.pdf.

(56) References Cited

OTHER PUBLICATIONS

Article entitled "M26 Modular Accessory Shotgun Systems Photos and Video" from the website "The Firearm Blog" dated Nov. 2, 2007; www.thefirearmblog.com/blog/2007/11/02/m26-modular-accessory-shotgun-system-photos-and-video/.
Catalog item LMT: Standard MRP (rifle) version from the website "Lewis Machine Tool Company" dated Jun. 2008; www.lewismachine.net/product.php?p=56&cid=8&session=85945e8b595ef2d461b8980961cf870a.
Article entitled "M16 rifle" from Wikipedia, the free encyclopedia dated Jun. 2008; http://en.wikipedia.org/wiki/M-16_rifle.
Article entitled "M4 Carbine" from Wikipedia, the free encyclopedia dated Jun. 2008; http://en.wikipedia.org/wiki/M4_carbine.
Animation entitled "How an AR15 Works" from the website dated Jun. 2008; www.barnesengineering.com/AR15animation/index.htm.
Article entitled "M26 Modular Accessory Shotgun System" from Wikipedia, the free encyclopedia dated Jul. 2009; http://en.wiki/M26_Modular_Accessory_Shotgun_System.

* cited by examiner

HAND GUARD MOUNTING MECHANISM

CROSS-REFERENCE TO RELATED APPLICATIONS

This application claims priority to and all advantages of U.S. Provisional Patent Application No. 61/597,980, which was filed on Feb. 13, 2012, the disclosure of which is specifically incorporated by reference.

FIELD OF THE INVENTION

The present invention relates to firearms and more specifically to a unique design for mounting a hand guard.

BACKGROUND

Various mechanisms are known in the industry for mounting a hand guard to a receiver of a firearm. Flush mounting between the hand guard and the receiver is preferred for aesthetics and stability of the firearm. If the hand guard mount does not abut the receiver and forms a gap, the firearm may be aesthetically unappealing, the hand guard may wobble and be unstable affecting the accuracy of the firearm, or debris may become lodged in the gap.

It is also important to be able to mount the hand guard to the firearm in an efficient manner using a small number of parts without having to use reduced tolerances between the parts. Therefore, there remains an opportunity to develop a firearm capable of securely mounting a barrel and a hand guard to a receiver in an efficient manner with both of these components adequately being secured to the receiver.

SUMMARY OF THE INVENTION AND ADVANTAGES

A firearm comprising a receiver including a threaded end with the receiver extending along an axis and a hand guard having an exterior surface and defining a hand guard bore along the axis with the exterior surface terminating at a mating surface disposed about the threaded end. The firearm additionally including a barrel disposed within the hand guard bore and abutting the threaded end and including a nut abutting the barrel and engaging the threaded end of the receiver to secure the barrel to the receiver. The firearm further including a securing device with the exterior surface of the hand guard defining an engagement area providing access into the hand guard bore and the securing device interfacing with the engagement area and extending into the hand guard bore to abut the nut and securely mount the mating surface of the hand guard to the receiver.

Accordingly, the present invention provides a firearm with a hand guard mount for securely mounting a barrel and a hand guard to a receiver using a single nut with both components abutting the receiver. Furthermore, the design of the hand guard mount allows for greater tolerances and results in a more atheistically appealing firearm.

BRIEF DESCRIPTION OF THE DRAWINGS

Other advantages of the present invention will be readily appreciated, as the same becomes better understood by reference to the following detailed description when considered in connection with the accompanying drawings.

DETAILED DESCRIPTION OF THE INVENTION

Figure 1:
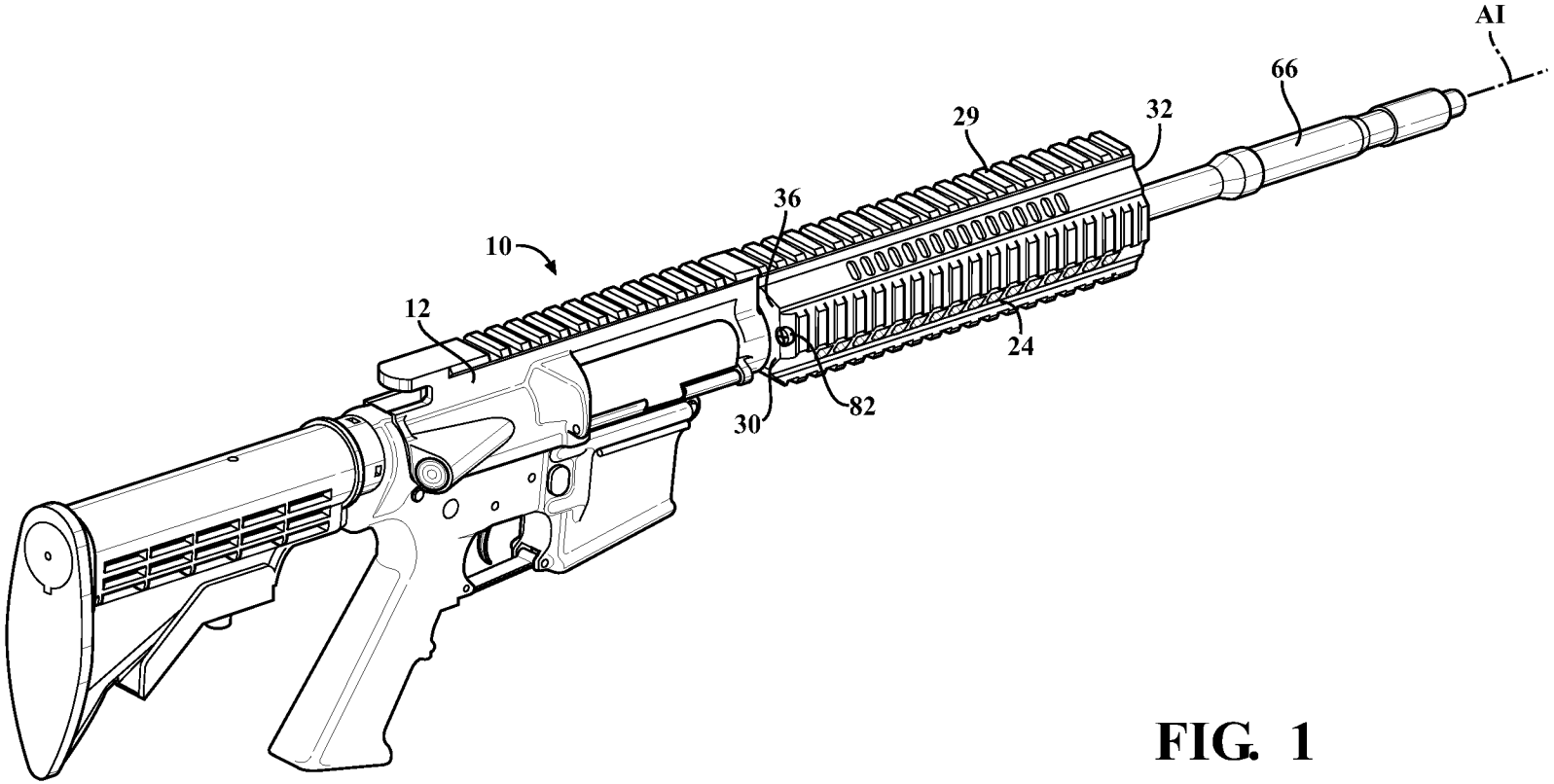
FIG. 1 is a perspective view of a firearm incorporating the components of the subject invention.

Referring to the Figures wherein like numerals indicates like or corresponding parts throughout the several views, a firearm 10 is generally shown in FIG. 1. The firearm 10 receives and fires live rounds of ammunition. Ammunition is also referred to as a cartridge, which includes a casing, a bullet, and other components known to those skilled in the art.

The firearm 10 can be of a certain class of firearms that utilize a direct gas impingement system or an indirect gas impingement system to eject a spent casing after firing the fire arm. Examples of such types of firearms include the M-16, the M4®, such as the M4® carbine, and the AR-15®, such as the AR-15® Platform. However, it should be appreciated that the firearm can be of any type without departing form the nature the nature of the present invention. The firearm described herein is designed to permit easy retro-fitting of the components to a variety of currently and/or previously manufactured firearm designs including direct gas impingement systems and indirect gas impingement systems.

Figure 2:
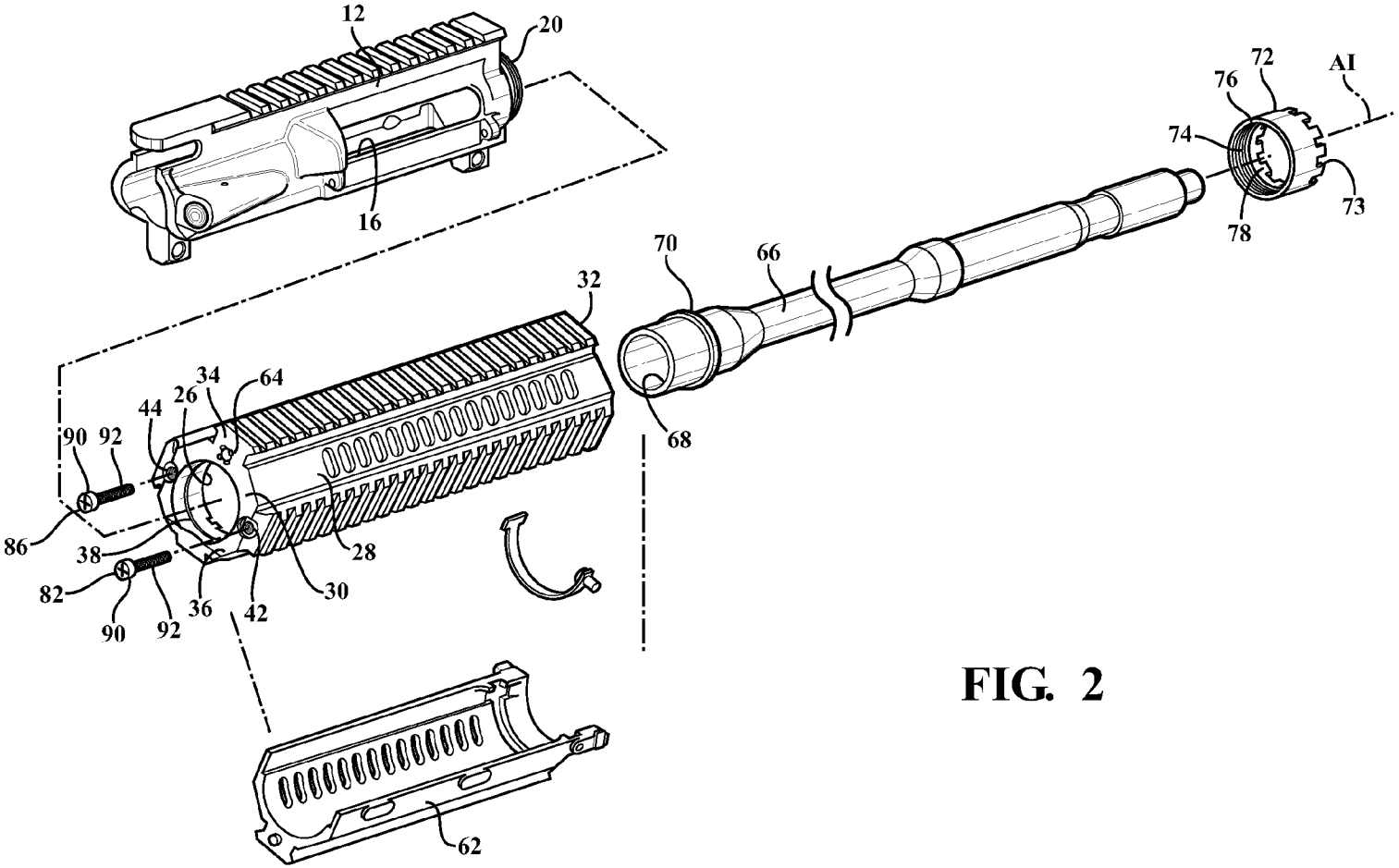
FIG. 2 is an exploded perspective view of an upper receiver, hand guard, barrel and nut of the firearm.
Figure 3:
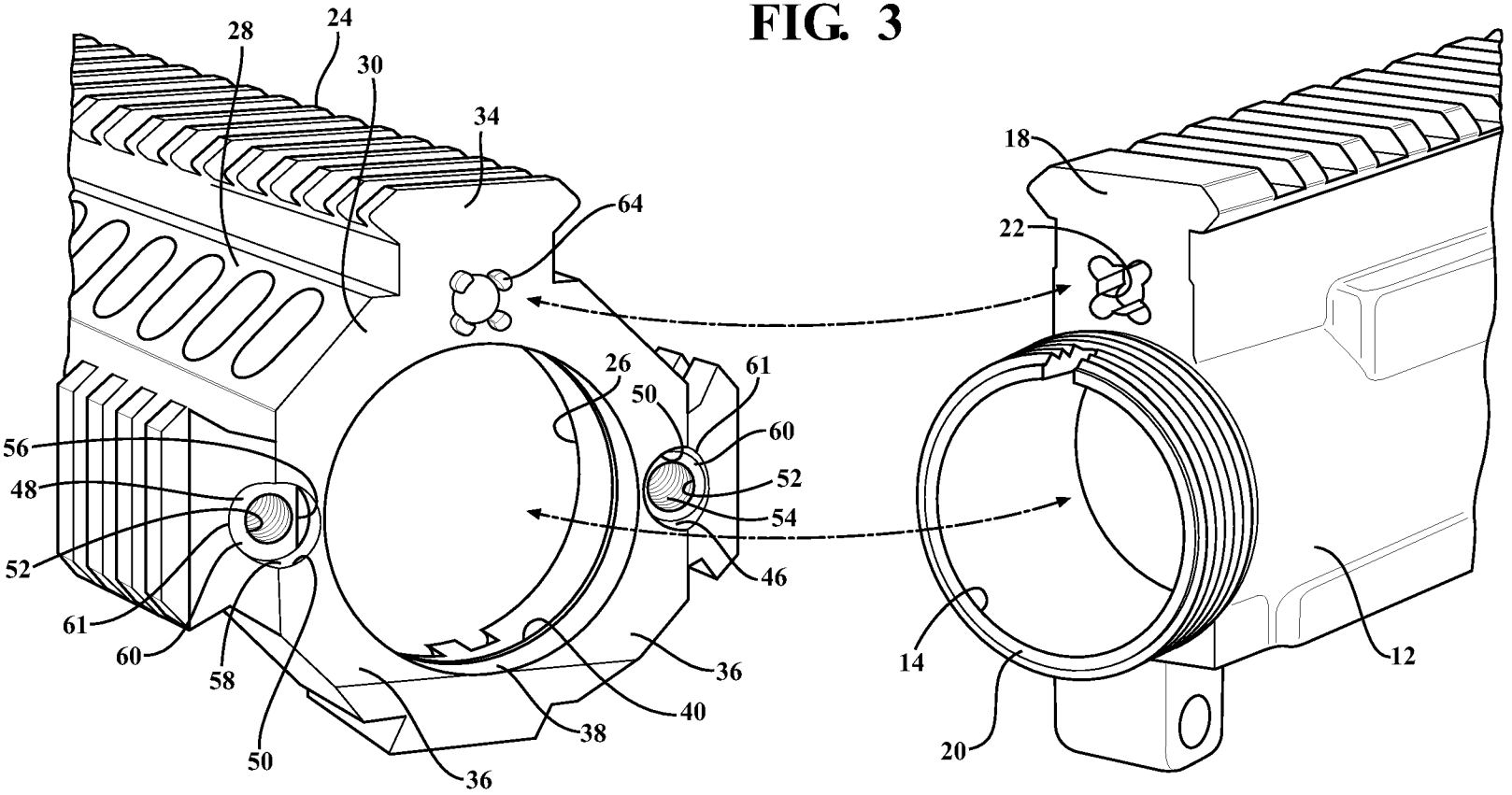
FIG. 3 is a fragmented exploded perspective view of the hand guard spaced from the receiver.

As also shown in FIGS. 2-3, the firearm 10 includes a receiver 12 defining a receiver bore 14 extending along an axis A1. The receiver 12 houses several working components of the firearm such as firing components, i.e. an action. The receiver 12 also defines an ejection port 16 transverse to the axis A1 for discharging spent casings. The receiver 12 additionally has an abutment surface 18 transverse to the axis A1 with the receiver bore 14 extending through the abutment surface 18.

As shown in FIG. 2, the receiver 12 has a threaded end 20 extending outwardly along the axis A1. More specifically, the threaded end 20 is substantially circular and extends from the abutment surface 18 with the receiver bore 14 extending through the threaded end 20. The receiver 12 further defines an aperture 22 in the abutment surface 18.

The firearm 10 includes a hand guard 24 defining a hand guard bore 26 along the axis A1. The hand guard 25 is attached to the receiver 12 such that the user can hold the hand guard 24 during operation of the firearm. The hand guard 24 protects the user from heat generated by the firearm. The hand guard 24 further has an exterior surface 28 extending along the axis A1 and spaced from the hand guard bore 26. The hand guard 24 may have rail devices 29 extending from the exterior surface 28 for mounting additional components to the firearm such as bipods, tripods, scopes, bayonets, lasers, shot guns, grenade launchers, etc.

As shown in FIG. 2, the hand guard 24 has a first end 30 and a second end 32 spaced from the first end 30 along the axis A1 with the hand guard bore 26 longitudinally extending to each of the first end 30 and the second end 32. The first end 30 abuts the receiver 12 when the hand guard 24 is mounted to the receiver 12. Turning to FIG. 3, the hand guard 24 further has a mating surface 34 with the exterior surface 28 terminating at the mating surface 34. More specifically, the mating surface 34 is disposed on the first end 30. The hand guard further has an end surface 36 adjacent to the mating surface 34. The mating surface 34 and the end surface 36 are coplanar and disposed on the first end 30 such that the mating surface 34 and the end surface 36 surround the hand guard bore 26. The mating surface 34 is transverse to the axis A1 such that the mating surface 34 faces the receiver 12. In other words, the mating surface 34 faces the abutment surface 18 of the receiver 12 and allows the hand guard 24 to be evenly secured to the receiver 12.

The hand guard 24 has a flange 38 extending into the hand guard bore 26 about the axis A1. The flange 38 surrounds the threaded end 20 of the receiver 12 when the hand guard 24 is mounted to the receiver 12. More specifically, the flange 38 is defined on the first end 30 with the mating surface 34 and the end surface 36 partially disposed on the flange 38. The flange 38 further has an inner surface 40 within the hand guard bore 26 facing the second end 32 of the hand guard 24.

As best shown in FIG. 2, the exterior surface 28 of the hand guard 24 defines an engagement area 42, 44 providing access into the hand guard bore 26. Specifically, the engagement area 42, 44 is defined at the end surface 36 of the first end 30. More specifically, engagement area 42, 44 is partially defined by the flange 38. The engagement area 42, 44 defines a cavity 46, 48 to further provide access to the hand guard bore 26. The cavity 46, 48 further includes a counter-sunk region 50 and a threaded region 52 adjacent and concentric with the counter-sunk region 50. The threaded region 52 extends into the counter-sunk region 50 and having a plurality of threads 54. The counter-sunk region 50 and the threaded region 52 are concentric with each other. However, it is to be appreciated, that the engagement area 42, 44 may be any suitable configuration for providing access to the hand guard bore 26.

Figure 4:
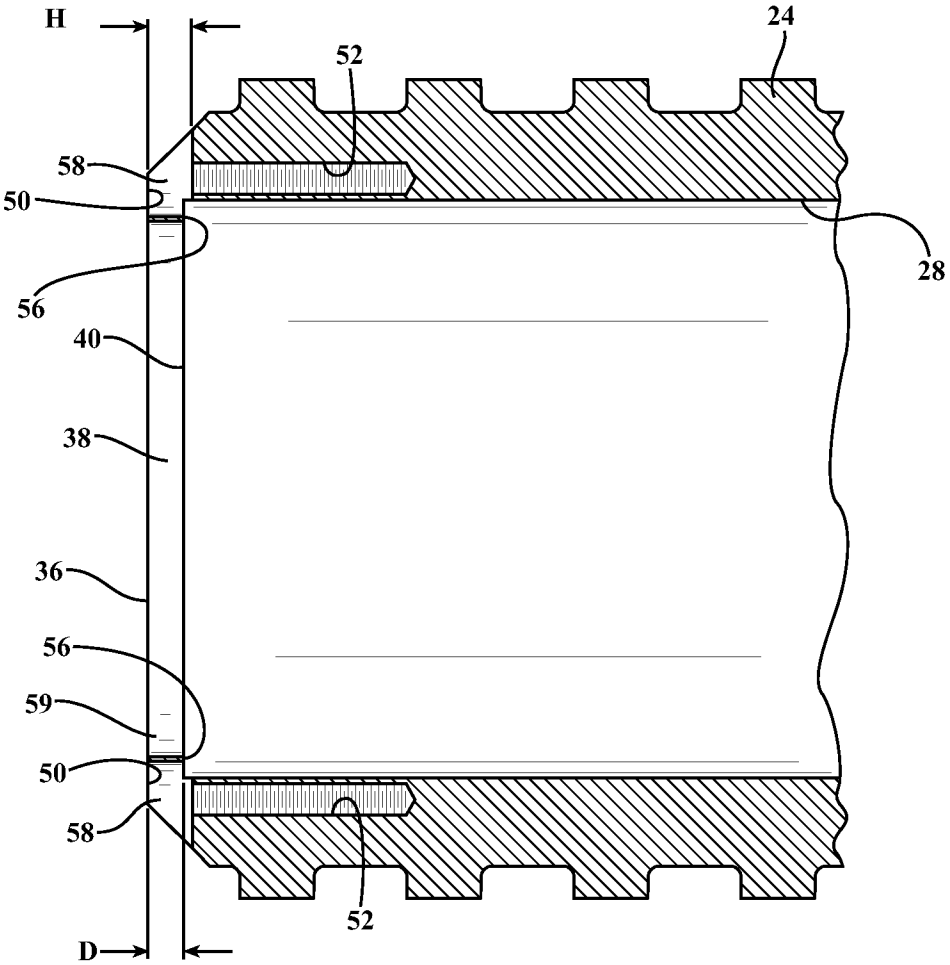
FIG. 4 is a fragmented cross-sectional top view of one end of the hand guard.

As best shown in FIG. 4, the hand guard 24 defines an opening 56 extending from the cavity 46, 48 into the hand guard bore 26 such that the hand guard bore 26 is accessible from the engagement area 42, 44. More specifically, the opening 56 extends from the cavity 46, 48 into the hand guard bore 26.

The hand guard 24 has a wall 58 with a height H. The wall defines a perimeter 61 of the engagement area 42, 44. The engagement area 42, 44 and extends into the first end 30 and has a depth. More specifically, the wall 58 is substantially circular and defines the counter sunk-region 50 in the first end 30. The hand guard 24 further has a thickness 59 defining a distance D between the mating surface 34 and the hand guard bore 26. More specifically, the flange 38 has the thickness 59 defines the distance D between the end surface 36 and the inner surface 40 with the height H of the wall 58 being greater than the thickness 59 of the hand guard 24 such that the opening 56 is defined in the hand guard 24. In other words, the depth of the counter-sunk region 50 is greater than the thickness 59 of the flange 38 with the opening 56 being defined where the engagement area 42, 44 is partially defined in the flange 38.

The engagement area 42, 44 has a bottom surface 60 with the opening 56 communicating with the bottom surface 60. The bottom surface 60 is adjacent to the wall 58 and partially defines the counter-sunk region 50. The threaded region 52 extends through the bottom surface 60. The opening 56 extends into the counter-sunk region 50 at the bottom surface 60. The inner surface 40 of the flange 38 is spaced from the bottom surface 60 of the engagement area 42, 44 such that the opening 56 is between the bottom surface 60 of the engagement area 42, 44 and the inner surface 40 of the flange 38.

As best shown in FIG. 2, the hand guard 24 further defines the engagement area 42, 44 as a first engagement area 42 and a second engagement area 44 disposed on an opposite sides of the axis A1 from the first engagement area 42. More specifically, the engagement area 42, 44 is defined as a first cavity 46 and a second cavity 48. The first and second engagement areas 42, 44 are substantially co-planar to each other and substantially symmetrically oppose each other relative to the axis A1.

As best shown in FIG. 2, the firearm 10 includes a second hand guard portion 62 selectively moveable between an assembled position engaged with the hand guard 24 and a disassembled position disengaged from the hand guard 24. In other words, the second hand guard portion 62 is removeably attached to the hand guard 24. The second hand guard portion 62 can be removed from the hand guard 24, for example, for providing access to the hand guard bore 26.

As best shown in FIG. 3, the hand guard 24 has plurality of protrusions 64 extending from the mating surface 34. The plurality of protrusions 64 are configured to be accepted within the aperture 22. The hand guard 24 is disposed around the threaded end 20 of the receiver 12 with the plurality of protrusions 64 of the hand guard 24 disposed in the aperture 22 of the receiver 12. The disposition of the plurality of protrusions 64 in the aperture 22 to aligns the hand guard 24 and the receiver 12. The threaded end 20 extends into the hand guard bore 26 at the first end 30 with the flange 38 disposed around the threaded end 20. The mating surface 34 of the hand guard 24 is substantially parallel to the abutment surface 18 of the receiver 12.

As best shown in FIG. 2, the firearm 10 includes a barrel 66 disposed within the hand guard bore 26 and abutting the threaded end 20 of the receiver 12. The barrel 66 defines a chamber 68 extending along the axis A1. The barrel 66 is disposed within the receiver bore 14 of the receiver 12. The barrel 66 extends through the second end 32 of the hand guard bore 26. As best shown FIGS. 5-7, the barrel 66 further has a shoulder 70 abutting the threaded end 20 of the receiver 12. The barrel 66 is a "floating barrel 66," i.e., the barrel 66 is only supported by the receiver 12 and is spaced from and not supported by the hand guard 24.

Figure 5:
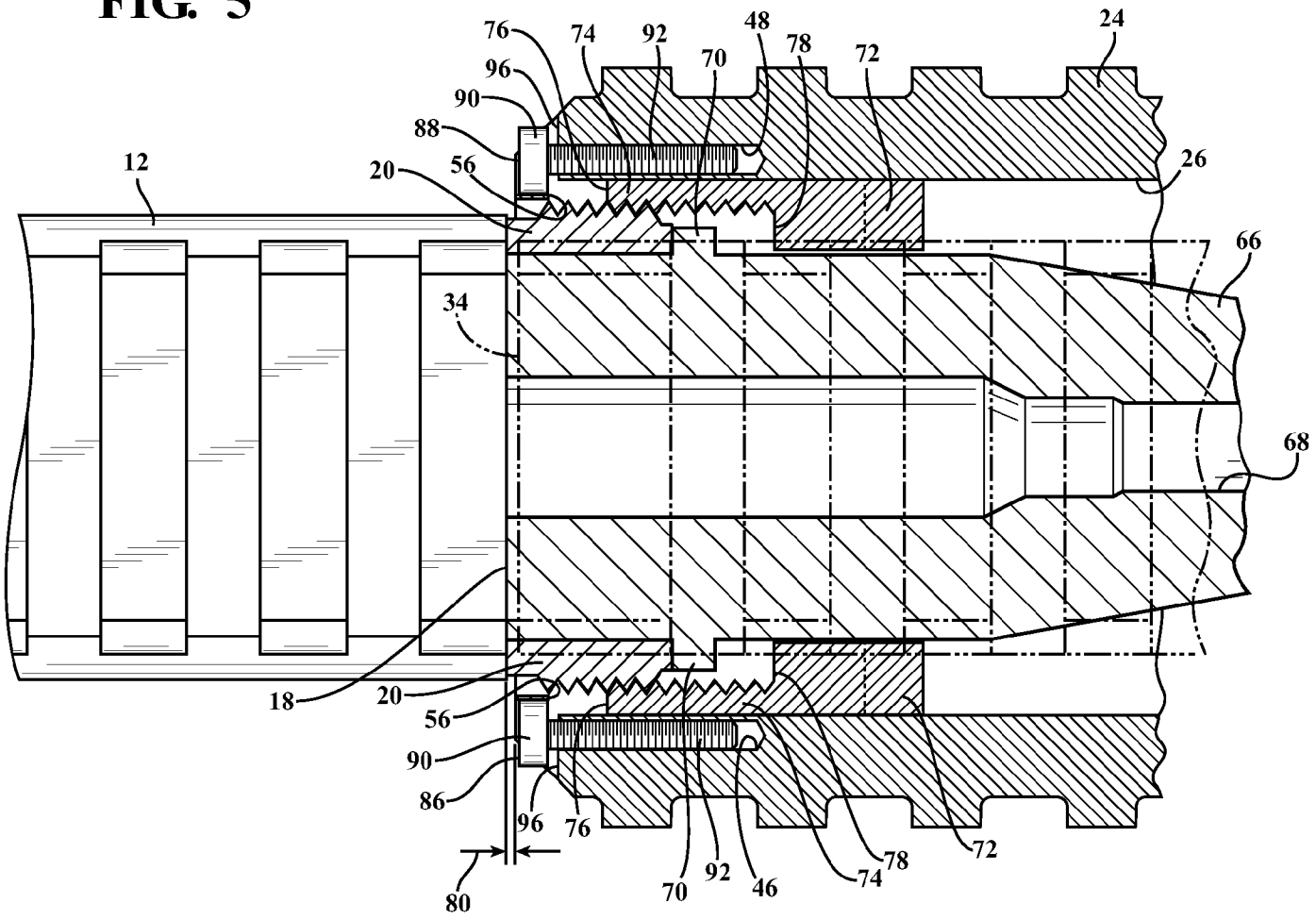
FIG. 5 is a fragmented cross-sectional top view of the nut engaging a threaded end of the receiver.
Figure 6:
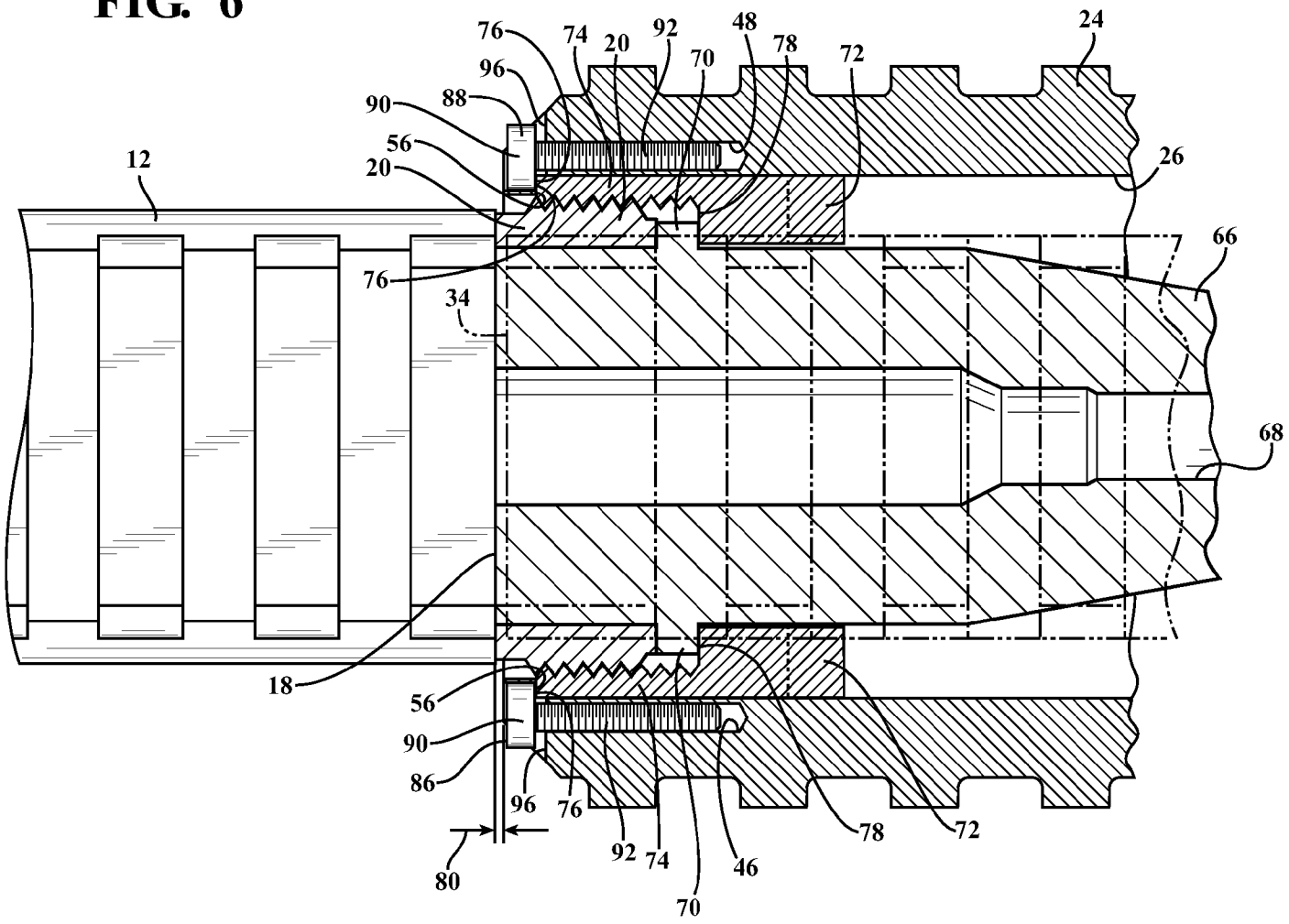
FIG. 6 is a fragmented cross-sectional top view of the barrel coupled to the threaded end of a receiver.
Figure 7:
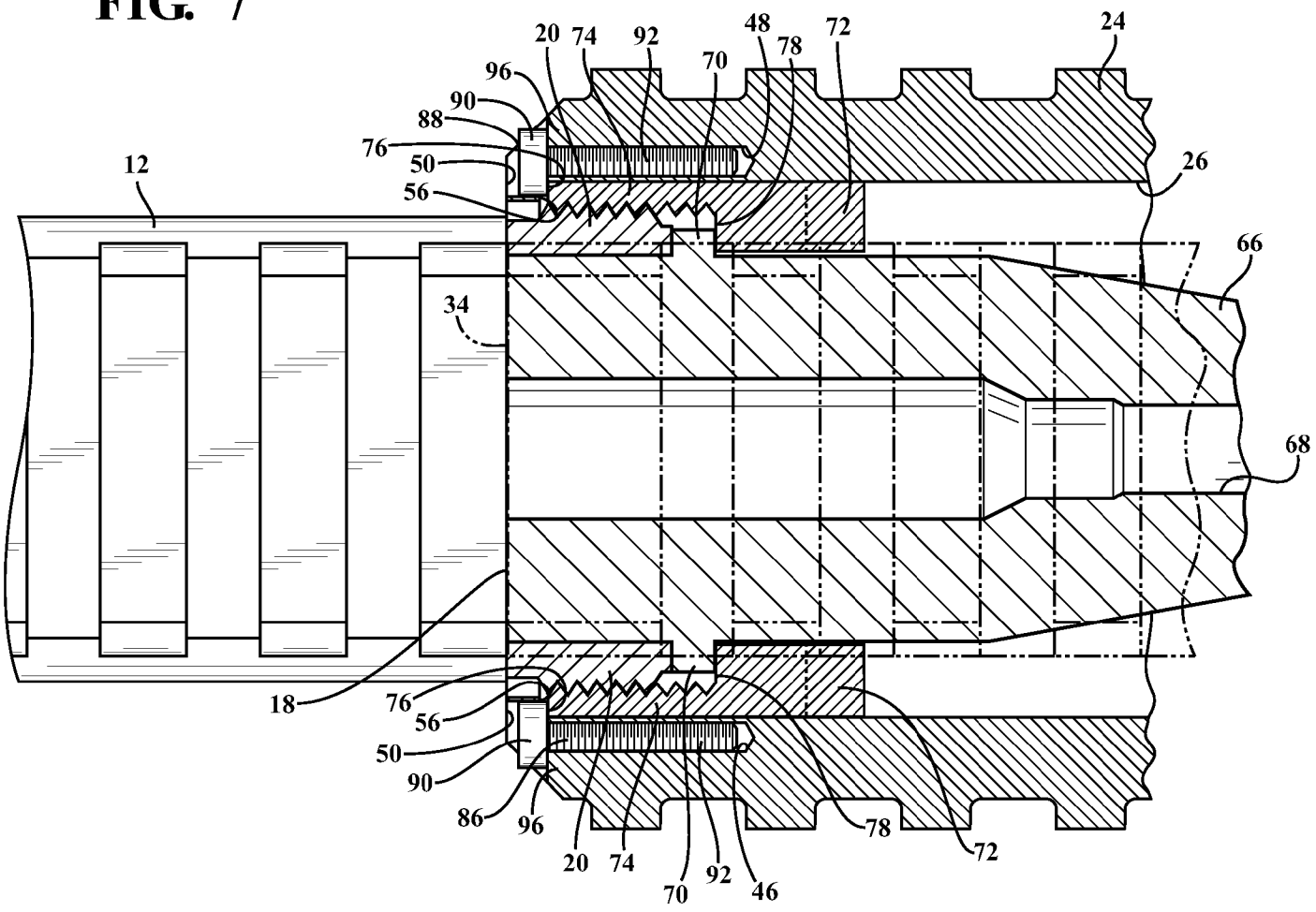
FIG. 7 is a fragmented cross-sectional top view of the hand guard securely mounted to the receiver.

The firearm 10 includes a nut 72 abutting the barrel 66. The nut 72 includes a threaded portion 74 having a nut end 76 and a projecting wall 78 with the threaded portion 74 extending for the projecting wall 78. The nut 72 further includes a set of teeth 73, as best shown in FIG. 2. The nut 72 is disposed around the barrel 66 and abuts the threaded end 20 of the receiver 12 as best shown in FIG. 5-7. A tightening tool can be inserted into the hand guard bore 28 to engage the set of teeth 73. When engaged with the set of teeth 73, the tightening tool can be rotated to threadedly engage or disengage the nut 72 with the threaded end 20 of the receiver 12. As the nut 72 is rotated and secured to the threaded end 20 of the receiver 12, the shoulder 70 of the barrel 66 is sandwiched between the threaded end 20 of the receiver 12 and the projecting wall 78 of the nut 72. The nut end 76 of the nut 72 is disposed relative to the opening 56 of the engagement area 42, 44 and is minimally spaced from the flange 38. As best shown in FIGS. 6-7, a gap 80 is defined between the alignment surface of the receiver 12 and the mating surface 34 of the hand guard 24. Alternatively, the nut 72 will securely mount the mating surface 34 of the hand guard 24 to the abutment surface 18 of the receiver 12 and the gap 80 is eliminated if the tolerances of the components allow for it.

Referring back to FIGS. 2-3, the firearm 10 includes a securing device 82, 84 disposed in the engagement area 42, 44 of the hand guard 24 to securely mount the hand guard 24 to the receiver 12.

The securing device 82, 84 is further defined as a first securing device 82 and a second securing device 84. More specifically, the first securing device 82 is a first bolt 86 and the second securing device 84 is a second bolt 88 with the first bolt 86 disposed in and interfacing with the first engagement area 42 and the second bolt 88 disposed in and interfacing with the second engagement area 44. Each of the first and second bolts 86, 88 have a head 90 and a shaft portion 92 with a plurality of threads 94. It is to be appreciated, that the securing device 82, 84 may be any suitable fastener for engaging the hand guard 24.

As shown in FIGS. 4-6, the heads 90 of the first and second bolts 86, 88 are disposed in the counter-sunk regions 50 of the first and second cavities 46, 48 and the shaft portions 92 are disposed in the threaded regions 52 of the first and second cavities 46, 48 with the plurality of threads 94 of the first and second bolts 86, 88 engaging the plurality of threads 54 of the first and second cavities 46, 48.

As the shaft portions 92 of the first and second bolts 86, 88 engage the threaded regions 52 of the first and second cavities 46, 48, the first and second bolts 86, 88 move axially toward the hand guard 24. The heads 90 of the first and second bolts 86, 88 are disposed in the counter sunk-regions 50 of the first and second cavities 46, 48 and extend through the openings 56. The first and second bolts 86, 88 move axially until the heads 90 abut the nut end 76 of the nut 72.

A pair of voids 96 are defined between the bottom surfaces 60 of the counter-sunk regions 50 and the heads 90 of the first and second bolts 86, 88. The pair of voids 96 allow the first and second bolts 86, 88 to remain axially static, continue to rotate against the nut 72, and engage the threaded regions 52 of the first and second cavities 46, 48.

As the shaft portions 92 of the first and second bolts 86, 88 continue to engage the threaded regions 52 of the first and second cavities 46, 48, the heads 90 if the first and second bolts 86, 88 abut and interface with the nut 72 to move hand guard 24 along the axis A1. The hand guard 24 moves along the axis A1 towards the receiver 12 and eliminates the pair of voids 96. Turning to FIG. 7, the hand guard 24 has moved along the axis A1 by the interface of the first and second bolts 86, 88, the first and second cavities 46, 48, and the nut such that the pair of voids has been eliminated. The interface of the first and second bolts 86, 88, the first and second cavities 46, 48, and the nut is sufficient to abut the mating surface 34 to the abutment surface 18 and securely mount the hand guard 24 to the receiver 12. In an alternative, the pair of voids 96 may continue to be defined, but would be reduced in size.

The present invention provides a method of assembling the hand guard 24. As described above, the firearm 10 includes a receiver 12 having a threaded end 20 with a barrel 66 secured to the receiver 12 by a nut 72 and a hand guard 24 disposed around a portion of the barrel 66, and a securing device 82, 84. The method includes the step of disposing the hand guard 24 about the threaded end 20 of the receiver 12. The method further includes the steps of disposing the barrel 66 within the hand guard 24 to abut the barrel 66 with the threaded end 20 of the receiver 12 and of disposing the nut 72 about the barrel 66 to abut the nut 72 with the threaded end 20 of the receiver 12. Furthermore, the method further includes the steps of rotating the nut 72 about the threaded end 20 of the receiver 12 to move the nut 72 towards the receiver 12 and coupling the barrel 66 to the threaded end 20 of the receiver 12 with the nut 72. The method also includes the steps of engaging the securing device 82, 84 with the hand guard 24, abutting the securing device 82, 84 with the nut 72, and manipulating the securing device 82, 84 against the nut 72 to move the hand guard 24 toward the receiver 12 until the hand guard 24 abuts the receiver 12. The step of manipulating the securing device 82, 84 is further defined as rotating the securing device 82, 84 against the nut 72 to move the hand guard 24 toward the receiver 12.

The present invention has been described herein in an illustrative manner, and it is to be understood that the terminology which has been used is intended to be in the nature of words of description rather than of limitation. Many modifications and variations of the present invention are possible in light of the above teachings. The present invention may be practiced otherwise than as specifically described within the scope of the appended claims. The subject matter of all combinations of independent and dependent claims, both singly and multiply dependent, is herein expressly contemplated.

What is claimed is:

1. A firearm comprising:

a receiver including a threaded end with said receiver extending along an axis;

a hand guard having an exterior surface and defining a hand guard bore along said axis with said exterior surface terminating at a mating surface disposed about said threaded end, with said mating surface being transverse to said axis such that said mating surface faces said receiver for mating said hand guard to said receiver;

a barrel disposed within said hand guard bore and abutting said threaded end;

a nut abutting said barrel and engaging said threaded end of said receiver to secure said barrel to said receiver; and a securing device;

said exterior surface of said hand guard defining an engagement area providing access into said hand guard bore and said securing device interfacing with said engagement area and extending into said hand guard bore to abut said nut and securely mount said mating surface of said hand guard to said receiver.

2. The firearm as set forth in claim 1 wherein said engagement area defines a cavity to further provide access to said hand guard bore with said securing device being at least partially disposed within said cavity.

3. The firearm as set forth in claim 2 wherein said cavity includes a counter-sunk region disposed within said cavity with said exterior surface to further provide access into said hand guard bore.

4. The firearm as set forth in claim 3 wherein said cavity includes a threaded region communicating with said counter-sunk region with said security device threadingly engaging said threaded region.

5. The firearm as set forth in claim 4 wherein said counter-sunk region and said threaded region are concentric with each other such that said securing device can simultaneously engage said threaded region and said counter-sunk region.

6. The firearm as set forth in claim 2 wherein said hand guard defines an opening extending from said cavity into said hand guard bore for providing said securing device access to said hand guard bore and said nut access to said cavity.

7. The firearm as set forth in claim 1 wherein said hand guard defines an opening and said engagement area has a bottom surface with said opening communicating with said bottom surface and said securing device abutting said bottom surface and extends into said hand guard bore.

8. The firearm as set forth in claim 1 wherein said hand guard defines an opening extending from said engagement area into said hand guard bore for providing access between said hand guard bore and said engagement area.

9. The firearm as set forth in claim 8 wherein said hand guard includes a wall having a height and defining a perimeter of said engagement area and wherein said hand guard further has a thickness defining a distance between said mating surface and said hand guard bore with said height of said wall being greater than said distance of said thickness of said hand guard such that said opening is defined in said hand guard extending from said engagement area into said hand guard bore.

10. The firearm as set forth in claim 1 wherein said hand guard includes a flange extending into said hand guard bore about said axis with said engagement area partially defined in said flange.

11. The firearm as set forth in claim 10 wherein said engagement area includes a bottom surface and wherein said flange includes an inner surface spaced from said bottom surface such that said hand guard defines an opening between said bottom surface of said engagement area and said inner surface of said flange.

12. The firearm as set forth in claim 1 wherein said securing device is a bolt having a shoulder with said bolt disposed in said engagement area such that said shoulder of said securing device extends into said hand guard bore and abuts said nut.

13. A firearm comprising:

a receiver including a threaded end with said receiver extending along an axis;

a hand guard having an exterior surface and defining a hand guard bore along said axis with said exterior surface terminating at a mating surface disposed about said threaded end;

a barrel disposed within said hand guard bore and abutting said threaded end;

a nut abutting said barrel and engaging said threaded end of said receiver to secure said barrel to said receiver; and a securing device;

said exterior surface of said hand guard defining an engagement area providing access into said hand guard bore and said securing device interfacing with said engagement area and extending into said hand guard bore to abut said nut and securely mount said mating surface of said hand guard to said receiver;

wherein said engagement area is defined as a first engagement area and said hand guard further defines a second engagement area disposed on an opposite side of said axis from said first engagement area for evenly securing the hand guard to said receiver.

14. The firearm as set forth in claim 13 wherein said securing device is further defined as a first securing device and further including a second securing device with said first securing device interfacing with said first engagement area and said second securing device interfacing with said second engagement area.

15. The firearm as set forth in claim 1 wherein said nut includes a threaded portion having a nut end and being disposed between said hand guard and said threaded end of said receiver along said axis with said securing device engaging said nut end to securely mate said hand guard to said receiver.

16. The firearm as set forth in claim 1 wherein in said securing device has a plurality of threads and said engagement area has a plurality of threads such that said plurality of threads of said securing device are disposed in and engaged with said plurality of threads of said engagement area as said securing device interfaces with said engagement area for manipulating said hand guard along said axis.

17. The firearm as set forth in claim 13 wherein said first and second engagement areas are substantially co-planar to each other and substantially symmetrically opposing each other relative to said axis for further securing the hand guard to said receiver along said axis.

18. The firearm as set forth in claim 13 wherein said mating surface is transverse to said axis such that said mating surface faces said receiver for mating said hand guard to said receiver.

19. The firearm as set forth in claim 13 wherein said hand guard defines an opening extending from said engagement area into said hand guard bore for providing access between said hand guard bore and said engagement area.

20. The firearm as set forth in claim 13 wherein said hand guard includes a flange extending into said hand guard bore about said axis with said engagement area partially defined in said flange.

* * * * *